US011097323B2

(12) United States Patent
Vignolo et al.

(10) Patent No.: US 11,097,323 B2
(45) Date of Patent: Aug. 24, 2021

(54) COMBINED CONTINUOUS CASTING AND METAL STRIP HOT-ROLLING PLANT

(71) Applicant: Danieli & C. Officine Meccaniche S.P.A., Buttrio (IT)

(72) Inventors: Luciano Vignolo, Udine (IT); Mauro Guagnelli, Udine (IT)

(73) Assignee: DANIELI & C. OFFICINE MECCANICHE S.p.A., Buttrio (IT)

( * ) Notice: Subject to any disclaimer, the term of this patent is extended or adjusted under 35 U.S.C. 154(b) by 39 days.

(21) Appl. No.: 16/494,190

(22) PCT Filed: Mar. 15, 2018

(86) PCT No.: PCT/IB2018/051746
§ 371 (c)(1),
(2) Date: Sep. 13, 2019

(87) PCT Pub. No.: WO2018/167711
PCT Pub. Date: Sep. 20, 2018

(65) Prior Publication Data

US 2020/0086368 A1 Mar. 19, 2020

(30) Foreign Application Priority Data

Mar. 15, 2017 (IT) ..... IT102017000028732

(51) Int. Cl.
*B21B 1/46* (2006.01)
*B21B 1/26* (2006.01)
(Continued)

(52) U.S. Cl.
CPC ..... *B21B 1/463* (2013.01); *B21B 1/26* (2013.01); *B21B 45/004* (2013.01);
(Continued)

(58) Field of Classification Search
CPC ..... B21B 1/26; B21B 1/24; B21B 2201/10; B21B 2015/0057
See application file for complete search history.

(56) References Cited

U.S. PATENT DOCUMENTS 4,630,352 A * 12/1986 Ginzburg ..... B21B 1/466 164/417
5,303,766 A * 4/1994 Kreijger ..... B21B 1/463 164/417
(Continued)

FOREIGN PATENT DOCUMENTS

CN 101678415 3/2010
EP 0980723 A2 2/2000
(Continued)

OTHER PUBLICATIONS

Machine Translation of KR-20100078425-A (Year: 2010).*

*Primary Examiner* — Jacob J Cigna
*Assistant Examiner* — Michael W Hotchkiss
(74) *Attorney, Agent, or Firm* — Stetina Brunda Garred and Brucker

(57) ABSTRACT

A combined continuous casting and endless rolling plant for a metal strip, comprising—a continuous casting line (1) for casting a slab; —a first rolling mill (6) for roughing the slab and for obtaining a transfer bar; —a second rolling mill (11) for finishing the transfer bar and for obtaining a strip; —a third rolling mill (18), comprising at least two rolling stands (17), for further reducing the N thickness of the strip; —accumulation means (20) of the strip comprising at least one first reel (37, 37') dimensioned to wind and unwind a coil weighing from 80 to 250 metric tons and/or up to 6 meters in diameter, named mega coil; —first cutting means (13), arranged between said third rolling mill (18) and said accumulation means (20), configured to cut the strip after the mega coil has been wound on the at least one first reel (37,
(Continued)

37'); —at least one second reel (48) for winding portions of strip, unwound from said accumulation means (20), up to a predetermined weight limit or coil diameter limit; —second cutting means (47), arranged between said accumulation means (20) and said at least one second reel (48), adapted to cut the strip whenever a portion of strip wound on the at least one second reel (48) reaches said predetermined weight limit or coil diameter limit.

20 Claims, 6 Drawing Sheets

(51) Int. Cl.
*B21B 45/00* (2006.01)
*B21B 15/00* (2006.01)

(52) U.S. Cl.
CPC ..... *B21B 2015/0014* (2013.01); *B21B 2015/0057* (2013.01); *B21B 2201/04* (2013.01)

(56) References Cited

U.S. PATENT DOCUMENTS 5,335,713 A * 8/1994 Hoppmann ..... B21B 1/466 164/269
5,433,264 A * 7/1995 Dorigo ..... B21B 1/26 164/417
5,634,257 A * 6/1997 Kajiwara ..... B21B 1/26 29/527.7
5,636,543 A * 6/1997 Kajiwara ..... B21B 1/26 72/234
5,657,814 A * 8/1997 Maebara ..... B21B 1/463 164/452
5,802,902 A * 9/1998 Rosenthal ..... C21D 9/60 72/201
5,956,990 A * 9/1999 Ginzburg ..... B21C 47/245 72/148
6,062,055 A * 5/2000 Bobig ..... B21B 1/26 72/200
6,092,586 A * 7/2000 Schonbeck ..... C21D 9/46 164/476
6,240,617 B1 * 6/2001 Nitoh ..... B21B 1/26 29/33 C
6,280,542 B1 * 8/2001 Cornelissen ..... C21D 8/0226 148/541
6,616,778 B1 * 9/2003 Bodin ..... B21B 1/26 148/541
6,773,522 B1 * 8/2004 Bodin ..... C21D 8/0226 148/541
7,181,946 B2 * 2/2007 Kruger ..... B21C 47/08 242/533.2
7,363,792 B2 * 4/2008 Modrow ..... B21B 1/466 72/201
7,954,539 B2 6/2011 Benedetti et al.
8,365,806 B2 * 2/2013 Rosenthal ..... C21D 9/60 164/460
9,433,983 B2 * 9/2016 Benedetti ..... B21B 1/463
9,821,369 B2 * 11/2017 Benedetti ..... B21B 13/22
10,286,432 B2 * 5/2019 Chung ..... B22D 11/1206
2001/0011565 A1 * 8/2001 Arvedi ..... B21B 1/00 148/546
2010/0175452 A1 * 7/2010 Ohlert ..... C21D 8/0463 72/200
2011/0289993 A1 * 12/2011 Gruss ..... B21B 37/26 72/7.1
2014/0072824 A1 * 3/2014 Linzer ..... C22C 38/00 428/586
2016/0339490 A1 * 11/2016 Chung ..... B22D 11/1206
2018/0029099 A1 * 2/2018 Sandrin ..... C21D 9/68
2019/0270160 A1 * 9/2019 Runkel ..... B23K 20/04

FOREIGN PATENT DOCUMENTS

GB 1075789 A * 7/1967 ..... B21C 47/34
KR 20100078425 A * 7/2010
WO WO0010741 A1 3/2000
WO WO2007073841 A1 7/2007

* cited by examiner

COMBINED CONTINUOUS CASTING AND METAL STRIP HOT-ROLLING PLANT

CROSS REFERENCE TO RELATED APPLICATION(S)

The present application claims priority to PCT International Application No. PCT/IB2018/0517445 filed on Mar. 15, 2018, which application claims priority to Italian Patent Application Nos. 102017000028732 filed Mar. 15, 2017, the entirety of the disclosures of which are expressly incorporated herein by reference.

STATEMENT RE: FEDERALLY SPONSORED RESEARCH/DEVELOPMENT

Not Applicable.

FIELD OF THE INVENTION

The present invention relates to a combined continuous casting and metal strip hot-rolling plant in austenitic range or in ferritic range, able to produce rolled strips in the form of coils.

PRIOR ART

The development of thin slab continuous casting plant technology has led to a remarkable development of combined plants in which casting is coupled with hot rolling. An example of such plants is described in document EP0980723A2.

In relation to the arrangement of the plant and to the installed auxiliary plants, three types of rolling plants and methods are known in the prior art, characterized by different dimensional and metallurgical performance (the latter meaning the product which can be obtained at the plant outlet), namely:

- Coil to coil, in which the continuous casted slab is cut into slab pieces to a size such that a coil of strip of the desired size wound on a winding reel is obtained for each slab piece at the end of the rolling process;
- Semi-endless, in which the continuous casted slab is cut into slab pieces to a size such that a length of strip corresponding to multiple coils of the desired size, e.g. from 3 to 7 coils, is obtained for each slab piece at the end of the rolling process; flying shears being successively used to obtain coils of desired size wound on the winding reels.
- Endless, in which the continuous casted slab seamlessly crosses the rolling mills, flying shears being successively used to obtain the coils of strip of desired size wound on the winding reels.

In order to overcome the limitations of each of the previous configurations, a plant was made and configured to be able to produce according to the three methods described above, in order to increase production flexibility and maximize the benefits which can be obtained by each production method.

Despite the development of the art, limitations which prevent completely replacing cold-rolled products with hot-rolled products, in the case of low-carbon steels, still remain. This means that, in order to obtain high quality products, low-carbon steel slabs must be cold-rolled, and therefore it is not possible hot-rolling only, immediately after the continuous casting. This implies that in the prior art, once the product has concluded the step of hot-rolling, it must be pickled to remove residual scaling and then cold-rolled. Annealing treatments and possible further tempering rolling follow to finalize the surface, i.e. cold-rolling to impart the desired roughness on the product surface, remove instability at the passage from elastic to plastic behavior and to improve strip planarity. Finally, the product is coated, e.g. by means of zinc or tin, and possibly painted (FIG. 7). Between one step and the next, the product, which is wound at the end of each treatment, may remain stationary in the warehouse for even several days. About two months may elapse from when the slab is cast to when the strip is ready for sale. So, disadvantageously two dedicated rolling lines are needed, one for hot rolling and another one for cold rolling, and the product processing completion time is very long.

Moreover, while the dimensional constraints are no longer a limit because minimum thicknesses of the order of 0.6-0.8 mm can be obtained, with tolerances comparable to those of a cold-rolled strip, the limit related to the mechanical properties remains.

Disadvantageously, from a dimensional point of view, the possibility of cutting and winding strips thinner than 0.6-0.8 mm is also extremely complex because of the high risk of jamming while handling the head and leading it in, with the consequent blocking of the entire casting and rolling process.

In addition, when rolling in austenitic range, there is a limit related to the mechanical properties of the product. This limiting constraint is related to the deformation anisotropy coefficient "r", which is much lower than that usually achieved by annealing after cold rolling, as a consequence of the different textures which develop. Additionally, as the final thickness decreases, there is a refinement of the microstructure, which leads to an increase of strength and reduction of ductility. This limits the use of hot-rolled strips to bending uses only, and in general to uses with very low deformations during moulding. Consequently, the possibility of replacing cold-rolled products with hot-rolled products is limited by the abovesaid problems.

Finally, the current range of Advanced High Strength Steels (AHSS) which can be obtained by known plants is limited, whereby reducing the production mix of types of steel which can be obtained with these plants.

The need to provide an innovative combined continuous casting and metal strip hot-rolling plant capable of overcoming the aforesaid drawbacks is therefore felt.

SUMMARY OF THE INVENTION

It is the primary object of the present invention to provide a combined continuous casting and metal strip hot-rolling plant which makes it possible to roll a wider range of products, and to obtain output thicknesses even thinner than 0.8 mm, whereby avoiding the difficulties of handling thin strips with respect to the solutions of the prior art.

It is another object of the invention to provide a plant which allows the continuous hot-rolling also of products which according to the prior art must be cold-rolled to obtain good mechanical properties, whereby dramatically reducing the processing cost and the crossing time through the entire plant for new products which, after hot-rolling, can replace those made using cold-rolling cycles, because the same properties are obtained from the process.

The present invention thus aims at reaching the objects discussed above by means of a combined continuous casting and metal strip endless rolling plant which comprises a continuous casting line for casting a slab;

a first rolling mill for roughing the slab and, for obtaining a transfer bar;

a second rolling mill for finishing the transfer bar and for obtaining a strip;

a third rolling mill, comprising at least two rolling stands, for further reducing the thickness of the strip;

accumulation means of the strip comprising at least one first reel dimensioned to wind and unwind a coil weighing from 80 to 250 metric tons and/or up to 6 meters in diameter, named mega coil;

first cutting means, arranged between said third rolling mill and said accumulation means, configured to cut the strip after the mega coil has been wound on the at least one first reel;

at least one second reel for winding portions of strip, unwound from said accumulation means, to a predetermined weight limit or coil diameter limit;

second cutting means, arranged between said accumulation means and said at least one second reel, adapted to cut the strip whenever a portion of strip wound on the at least one second reel reaches said predetermined weight limit or coil diameter limit.

First weight and/or diameter sensors of the coil being wound on at least one first reel are provided to send a command signal to the first cutting means whenever the mega coil has been wound on the at least one first reel.

Second weight and/or diameter sensors of the coil being wound on at least one second reel are provided to send a command signal to the second cutting means whenever a portion of strip wound on the at least second reel reaches said predetermined coil weight limit or diameter limit.

A second aspect of the present invention provides a continuous casting and endless rolling process of metal strip, performed by means of the aforesaid plant, which comprises the following steps:

a) casting a slab by means of the continuous casting line;

b) roughing the slab to obtain a transfer bar by means of the first rolling mill;

c) finishing the transfer bar to obtain a strip by means of the second rolling mill;

d) further reducing the thickness of the strip by means of the at least two rolling stands of the third rolling mill;

e) winding the strip, by means of the at least one first reel of the accumulation means to form a coil weighing from 80 to 250 metric tons and/or up to 6 meters in diameter, named mega coil;

f) cutting the strip by means of the first cutting means, after the mega coil has been wound on the at least one first reel;

g) unwinding the strip on the at least one first reel and winding a portion of strip on the at least one second reel to a predetermined weight limit or coil diameter limit, thereby defining a first coil;

h) cutting the strip, by means of the second cutting means, after the formation of said first coil;

i) winding on said at least one second reel further portions of strip up to said predetermined weight limit or coil diameter limit, thereby defining further coils, by cutting the rolled strip by means of the second cutting means after forming each of said further coils.

In this description, mega coil means a coil of strip, weighing from 80 to 250 metric tons and/or of up to 6 meters in diameter, preferably from 3 to 6 meters.

Advantageously, by applying the mega coil winding concept according to the invention, the risk of jamming due to the introduction of strips with portions thinner than 0.8 mm, preferably thinner than 0.7 mm, is null, despite the fast rate of advancement of the strip. Indeed, in an endless rolling mill with casting process associated with the hot-rolling process, it is the casting speed to determine the output speed of the strip from the hot rolling mill. For example, with a 110 mm thick slab and a casting speed of 6 m/min, the output speed of the finishing mill is equal to 660 m/min in order to obtain a 1.0 mm thick strip. By further reducing the thickness of the output strip, e.g. to 0.5 mm, the speed of the strip reaches 1320 m/min. So, by halving the desired strip thickness, the winding speed of the strip at the outlet of the rolling mills must also be doubled. With such advancement and winding speeds, in order to avoid jamming, controlling the head of the strip, cut on the fly, is practically impossible with ordinary guiding devices. Therefore, providing high-capacity accumulation, means for winding mega coils in the plant of the invention is extremely advantageous in order to increase continuous rolling process reliability.

A further advantage is in that a much more compact and versatile line can be obtained, which makes it possible to simplify the process of the prior art (FIG. 7), whereby reducing the product processing completion time, which may pass from about two months to one month. In particular, once having have crossed the single rolling layout of the plant of the invention comprising the three hot-rolling mills, in order to be made ready for selling, the strip only needs to be successively pickled, and possibly surface-worked by tempering rolling, coated, painted (FIG. 8). Indeed, all the remaining heat and rolling treatments are performed aboard the single rolling layout. This makes it possible to shorten the time between product casting and its finalization in view of sales, which becomes less than a month.

Additionally, by means of the layout which is object of the present invention, DQ (Drawing Quality), DDQ (Deep-Drawing Quality) and EDDQ (Extra Deep-Drawing Quality) products, which are currently made exclusively on cold-rolling plants, can be made and have properties at least equal to those made with the plants of the prior art.

Advantageously, the plant of the invention provides a third rolling mill with at least two further rolling stands downstream of the Finishing mill, which further rolling stands make it possible to further reduce the thickness of the strip and may be preceded, in a variant of the invention, by a rapid heating device or by a rapid cooling device, according to whether it is desired to work in austenitic range or in ferritic range.

A further rapid heating device may be provided upstream of the finishing mill in order to keep the rolling in austenitic range.

When a product is rolled with these two additional rolling stands, to make it thinner than 0.8 mm, the need to manage this product during the cutting and the rolling arises. Indeed, the strip is not sent directly to the conventional winding reels, suitable for winding strip with a thickness of at least 1 mm, but after being cooled by the laminar cooling line, it is sent to an accumulation station of the Mega coil type, which in turn sends it to final winding reels.

The weights of the final coils on the final winding reels are fixed on automation level, by setting a weight limit and optionally a diameter limit. The first of the two limits to be reached by the final coils, detected by means of weight and/or diameter sensors, starts the cutting using shears.

In a preferred embodiment of the plant of the invention, the accumulation station of the Mega coil type is coupled to a cutting and winding line comprising at least one reel and cutting means upstream of said at least one reel. The strip is cut by the cutting means as soon as on the reel it is produced a coil of strip with a specific weight of from 10 to 20 kg/mm, e.g. obtaining coils weighing up to 35 metric tons, preferably from 8 to 35 metric tons. The plant continues with this working method until the complete unwinding of the mega coil from which from 5 to 8 coils are obtained, for example, possibly of different thicknesses and weights. Such embodiment provides a final strip thickness from 0.5 to 1.0 mm.

As known, specific weight is a method used in the steel industry to define the weight of the coils processed by the plants. For instance, 18 kg/mm means that in order to calculate the weight (kg) of the coil it will suffice to multiply the width (mm) of the strip by the specific weight (kg/mm).

In the case of stretches of strip forming the Mega coil having different thickness, the rolling stands of the third rolling mill are programed to roll to a specific thickness, which may be either equal for all stretches of strip or different according to the final production requirements and to the desired thickness of the production batch.

The working method provides that when an ultra-thin strip campaign is started, a strip of a thickness such as to minimize the risks of jamming is firstly roiled, e.g. thicker than or equal to 1 mm, which will initially be wound on conventional winding systems.

When it is desired to start reducing the thickness to less than 1 mm and to obtain stretches of strip of different thickness, the strip is cut by means of a flying cutting shear; the tail of cut strip is wrapped around the coil already wound on the conventional reel, while the head of the strip obtained by cutting is routed toward the accumulation means comprising two reels for mega coils, for example. The winding on one of these mega coil reels is promoted by a belt wrapper which promotes the winding of the first turns. Once the winding reel has tensioned the strip, the wrapper opens and gradually the stands of the third rolling mill begin to roll at different thicknesses, whereby producing stretches of strip of decreasing and then increasing thickness with respect to an initial thickness of at least 1 mm, which are seamlessly wound on the mega coil winding reel.

Advantageously, any deviation of the strip from the center line of the plant may be measured by appropriate optical sensors and a centering system moves the mega coil winding reel which is mounted on slides to allow this movement with low friction, the movement being controlled by hydraulic actuator.

The dependent claims describe preferred embodiments of the invention.

BRIEF DESCRIPTION OF THE FIGURES

Further features and advantages of the present invention will be more apparent in light of the detailed description of a preferred, but not exclusive, embodiment of a combined continuous casting and metal strip rolling plant illustrated by way of non-limiting example, with the aid of the accompanying drawings, in which.

The same reference numbers in the figures identify the same elements or components.

DETAILED DESCRIPTION OF PREFERRED EMBODIMENTS OF THE INVENTION

Figure 1:
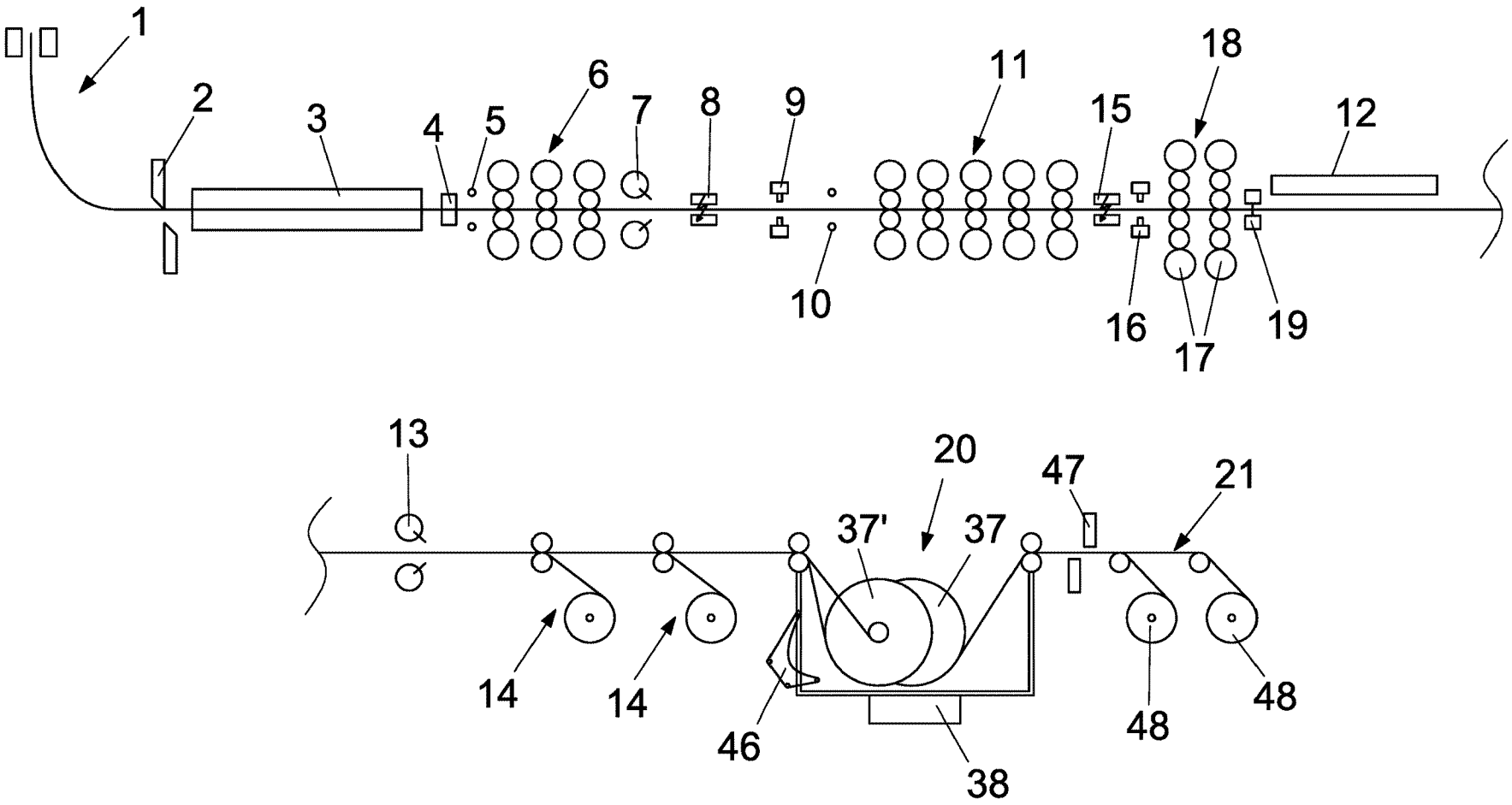
FIG. 1 is a diagrammatic view of an embodiment of a plant according to the invention.

Figures from 1 to 6 show preferred embodiments of a combined plant of continuous casting and rolling of thin slab to obtain a strip in endless mode to obtain coils of strip. The material of the strip is preferably steel.

The plant, which is object of the present invention, in all its embodiments, comprises in succession:

- a continuous casting machine 1 for casting a slab, preferably a slab having a thickness comprised between 30 and 140 mm;
- a first rolling mill 6 or roughing mill, preferably comprising one to four rolling stands, in order to perform a hot roughing of the slab and to obtain a blank, i.e. the so-called transfer bar;
- a second rolling mill 11 or finishing mill, preferably comprising from three to seven rolling stands, in order to perform a hot finishing of the transfer bar and to obtain a strip;
- a third rolling mill 18, comprising at least two rolling stands 17, for further reducing the thickness of the strip; said at least two rolling stands 17 being preferably four-high stands or even more preferably six-high stands;
- accumulation means 20 of the strip comprising at least one first high-capacity reel 37, 37', dimensioned to wind and unwind a coil weighing from 80 to 250 metric tons and/or up to 6 meters, preferably from 3 to 6 meters, in diameter, named mega coil;
- and a cutting and winding line 21 provided with
- at least one reel 48 for winding portions of strip up to a predetermined weight limit or coil diameter limit;
- cutting means 47, arranged between said accumulation means 20 and said at least one reel 48, adapted to cut the strip whenever a portion of strip wound on the at least one reel 48 reaches said predetermined weight limit or coil diameter limit.

Advantageously, providing the third rolling mill 18 and the particular accumulation means 20 make it possible to obtain products, possibly of different thickness and quality, even very thin, while avoiding the risk of jamming deriving from the process.

In a preferred variant, common to all the embodiments of the plant of the invention, the accumulation means 20 comprise two high-capacity reels 37, 37' integral with a rotatable platform 38, e.g. fixed to opposite ends of the rotatable platform. This platform 38 may rotate, e.g. by 180°, about a vertical axis after a predetermined period of time during which a mega coil is wound on one of the two reels 37, 37', so that alternatively the reel 37 is used as the winding reel of continuous strip coming from the third rolling mill 18 and the reel 37' is used as the unwinding reel of continuous strip for feeding it toward said at least one reel 48.

The reels 37, 37' are preferably made of a thick tube or of a metal rod capable of supporting the weight of the coils of large size up to 250 metric tons of weight or 6 meters in diameter.

A metal belt wrapper 46, which winds around the reel 37 or 37' ready to receive the head of hot-rolled strip to obtain a mega coil, is advantageously provided.

Cutting means 13 are provided upstream of the rotatable platform 38, configured to cut the strip once a coil of weight from 80 to 250 metric tons and/or diameter up to 6 meters, preferably from 3 to 6 meters, has been wound on one of the two reels 37, 37'. Dedicated weight and/or diameter sensors send a command signal to the cutting means 13 once the weight limit, e.g. 250 metric tons, or the diameter limit of a coil, e.g. 6 meters, has been reached. The 180° rotation of the rotatable platform 38 takes place after this cut.

These cutting means 13 preferably consist of a flying cutting shear, for example sized to cut on the fly at advancement speeds of the strip of up to about 25 m/s. Cutting means 47 preferably consist of a static shear, instead.

The rotatable platform 38, defining a dual winding/unwinding system of the strip, can be driven by means of, for example, a rack system. Its rotation is controlled by a control unit, constituted for example by an electric or hydraulic motor 45, a gearbox and a pinion which meshes with the rack mounted on the rotatable platform 38.

The rotation controls 44, 43 and 41, 40 of the respective reels 37', 37 are mutually independent so as to independently control the winding rotation of the strip coming from the third rolling mill 18 and the unwinding rotation of the strip towards said at least one reel 48.

During the 180° rotation of the rotatable platform 38, the rotation controls 44, 43 and 41, 40 are uncoupled from the respective reels 37', 37 by means of a respective movable joint 39, 42, which is retracted.

The strip wound and unwound on the reels 37, 37' is kept aligned and centered by means of an axial movement of a respective mandrel 34, 34' controlled by a corresponding hydraulic cylinder 33, 33'.

Furthermore, again in common to all the embodiments of the invention, the following are provided in succession downstream of the continuous casting machine 1:

- optional shears 2, for example oscillating shears for cutting the slab in cases of emergency;
- an optional tunnel furnace 3, for maintaining or equalizing or increasing the temperature of the slab;
- at least one optional vertical rolling stand 4 (edger), or at least one optional press, to reduce the width of the slab and bring it closer to that of the strip which is desired to be obtained, in order to reduce waste and improve yield;
- an optional first descaling device 5, immediately upstream of the roughing mill 6;
- optional shears 7 for cutting the transfer bar in cases of emergency or to eliminate the ends which may have an irregular shape, whereby avoiding damage to the working rolls of the finishing mill 11 and reducing the likelihood of jamming with consequent generation of waste;
- an optional rapid heating device 8, e.g. an induction heating device, the power of which can be modulated and appropriately activated to restore the temperature that the product loses during roughing and to thus enter into the finishing mill remaining in austenitic range;
- an optional second descaling device 10, immediately upstream of the finishing mill 11;
- an optional laminar cooling device 12, e.g. in the form of a roller table, located downstream of the at least two rolling stands 17 of the third rolling mill 18 and immediately upstream of the cutting means 13, said roller table being provided with laminar cooling systems for the upper and lower surface of the strip being rolled;
- at least two optional winding systems 14, arranged downstream of the cutting means 13, comprising, for example, pinch rollers and deflectors, winding reel, winding rolls and coil unloading system; said winding systems 14 being used for winding strips rolled to conventional thickness from 1 to 25 mm without using the two rolling stands 17 for ultra-thin thicknesses.

Advantageously, a rapid heating device 15, e.g. an induction heating device, and/or a rapid cooling device 16, e.g. a device for producing blades or sprays of cooling liquid on both the upper and lower surfaces of the strip, are provided between the finishing mill 11 and the third rolling, mill 18.

The rapid heating device 15 is adapted to be activated if the rolling is kept in austenitic range also in the at least rolling stands 17, while the first rapid cooling device 16 is adapted to be activated if the rolling is changed from austenitic range to ferritic range.

Immediately downstream of the third rolling mill 18 and upstream of the laminar cooling device 12, a further rapid cooling device 19 is provided, with the purpose of reducing the temperature of the newly rolled product and achieving a refinement of the micro structure as a result of the high driving force.

Figure 2:
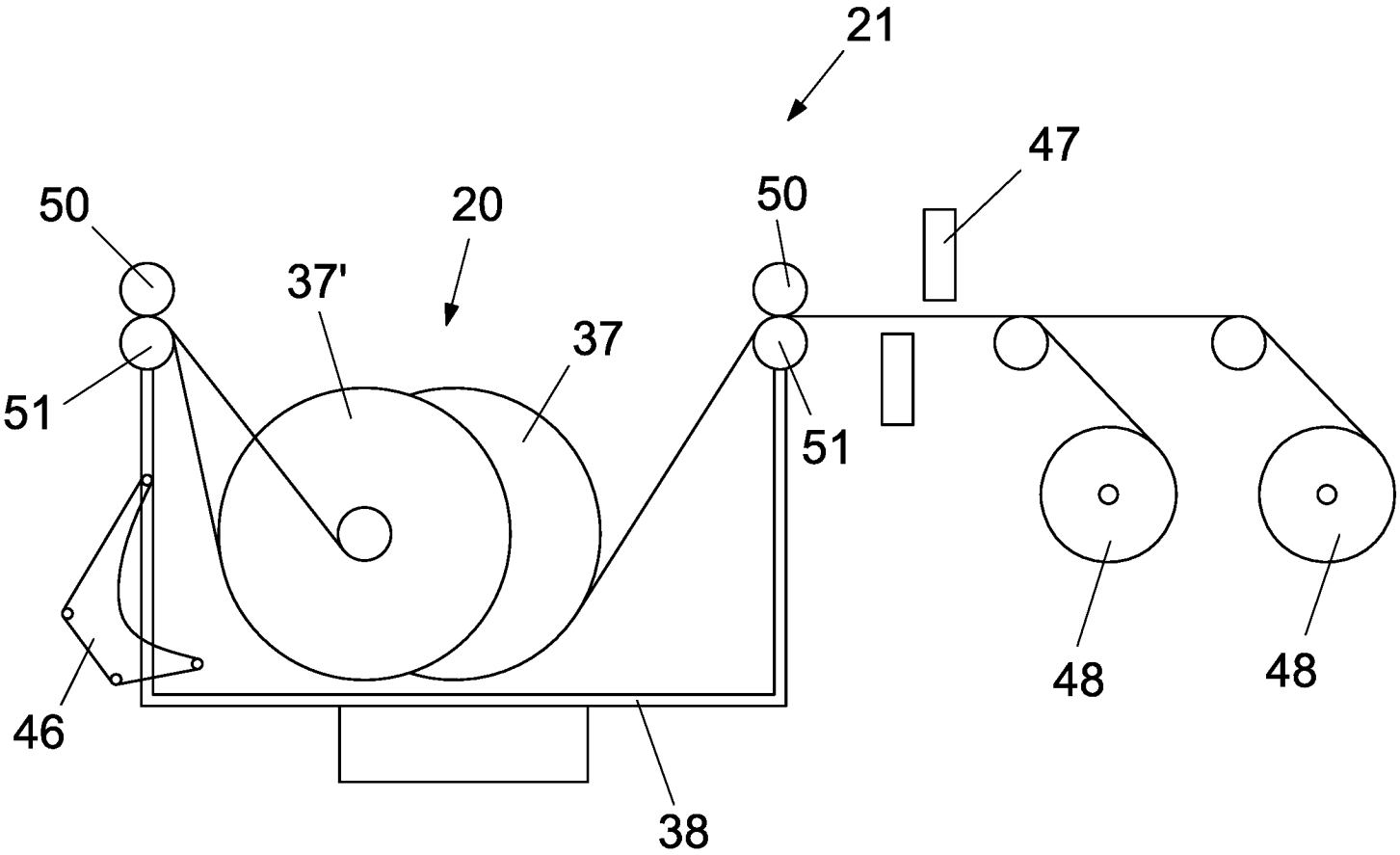
FIG. 2 is an enlarged diagrammatic view of the part of the plant in FIG. 1.

In a preferred embodiment of the invention, shown in FIGS. 1 and 2, downstream of the accumulation means 20, comprising the rotatable platform 38 and the two reels 37, 37, the cutting and winding line 21 comprises static cutting shears 47 and at least two reels 48, advantageously sized for winding strip portions up to a predetermined weight limit, e.g a specific weight of from 10 to 20 kg/mm, whereby obtaining coils up to 35 metric tons, preferably from 8 to 35 metric tons of weight, and preferably with a maximum diameter of 2.1 m. For example, only two reels 48 or more than two reels 48 can be provided.

A variant provides the use of flying cutting shears, instead of the static cutting shears 47, and the use of a carousel of reels as an alternative to the two separate reels 48. The carousel has generally two reels, which are diametrically opposite to one another and hinged onto a rotating drum, which alternatively wind the rolled strip: when one of the reels is winding a final coil, the other reel is freed of the previously wound final coil.

Some advantageous methods of operation of this embodiment of the plant of the invention are described below (FIGS. 1-4).

In a first advantageous method of operation, rolling is provided in rolling trains 6, 11 and 18 always in austenitic range.

The process performed in this first method comprises the following steps in succession:

- casting a thin slab having a thickness, e.g. comprised between 30 and 140 mm, preferably between 80 and 140 mm, by means of the continuous casting machine 1;
- optionally keeping or equalizing or increasing the temperature of the slab by means of the tunnel heating furnace 3;
- optionally reducing the width of the slab, and bringing it closer to that of the strip to be obtained, by means of the at least one vertical rolling stand 4, if provided;

optionally performing the descaling of the slab, before roughing, by means of the first descaling device 5;

performing the hot roughing of the slab by the roughing mill 6, producing a transfer bar, preferably of thickness of about 5-50 mm;

optionally actuating, if provided, the shears 7 for cutting the transfer bar in cases of emergency or to eliminate the ends which may have irregular shape;

optionally heating the transfer bar by means of the rapid heating device 8, e.g. induction heating device, to restore the temperature that the product lost during roughing and to thus enter into the finishing train 11 remaining in austenitic range;

optionally descaling the transfer slab, before finishing, by means of the second descaling device 10, if provided;

performing the hot finishing of the transfer slab by means of the finishing mill 11, obtaining a strip, preferably of thickness of about 1-25 mm;

optionally heating the strip by means of the rapid heating device 15 to restore the temperature that the product lost during finishing and to thus enter into the rolling mill 18 remaining in austenitic range;

further reducing the thickness of the strip, preferably to about 0.5-1 mm, by means of the third rolling train 18;

optionally cooling the strip by means of the further rapid cooling device 19, to reduce the temperature of the strip and obtain a refinement of the microstructure;

optionally cooling the strip by means of the laminar cooling device 12.

Figure 5:
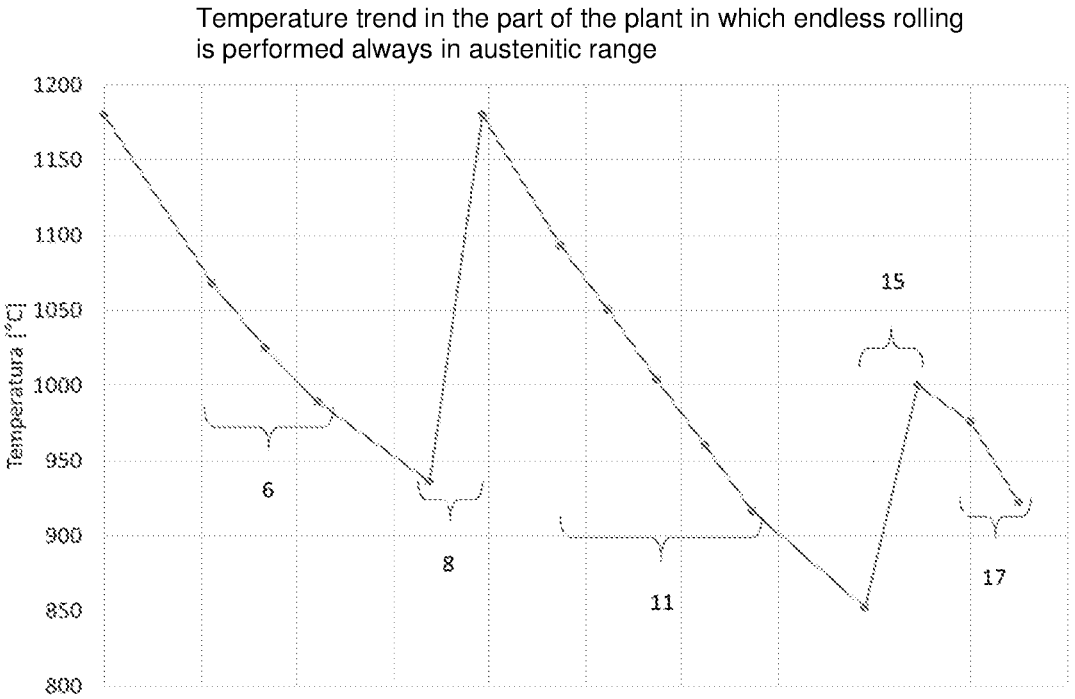
FIG. 5 is an example of the temperature trend in the part of the plant in which the endless rolling is performed always in austenitic range.

In this first operating method, the strip, at the outlet of the finishing mill 11, in order to maintain an adequate temperature for the successive rolling still in austenitic range, can be heated by the rapid heating device 15, e.g. an inductor. This expedient prevents the passage of phase between finishing mill 11 and the at least two rolling stands 17. An example of the temperature trend is shown in FIG. 5, in which the numbers are referred to the components shown in FIG. 1.

The strip is rolled in at least two rolling stands 17 to achieve thicknesses thinner than 0.8 mm, e.g. thinner than 0.7 mm. Considering the fast rolling speed and the ultra-thin thickness, it is preferable for the stands 17 to be of the six-high stand type to achieve a better planarity control.

At the outlet of the at least two—preferably two—rolling stands 17, the strip may undergo an accelerated cooling by virtue of the further rapid cooling device 19. The latter makes it possible, in combination with the laminar cooling device 12, to be able to obtain AHSS steels (DP, TRIP, CP, MS) by applying appropriate cooling cycles. These steels have a minimum rolling thickness which depends upon the grade. The two stands 17, together with the inductive heating which precedes them by means of the rapid heating device 15, make it possible to reduce the minimum rolling thickness. The two stands 17 are also designed in such a way as to be able to apply an asymmetric rolling process in order to obtain the so-called deformation induced ferrite transformation (DIFT) rolling, which makes it possible to obtain steel with ultra-fine grain, and consequently high-strength strips with lean chemical Composition.

Figure 3:
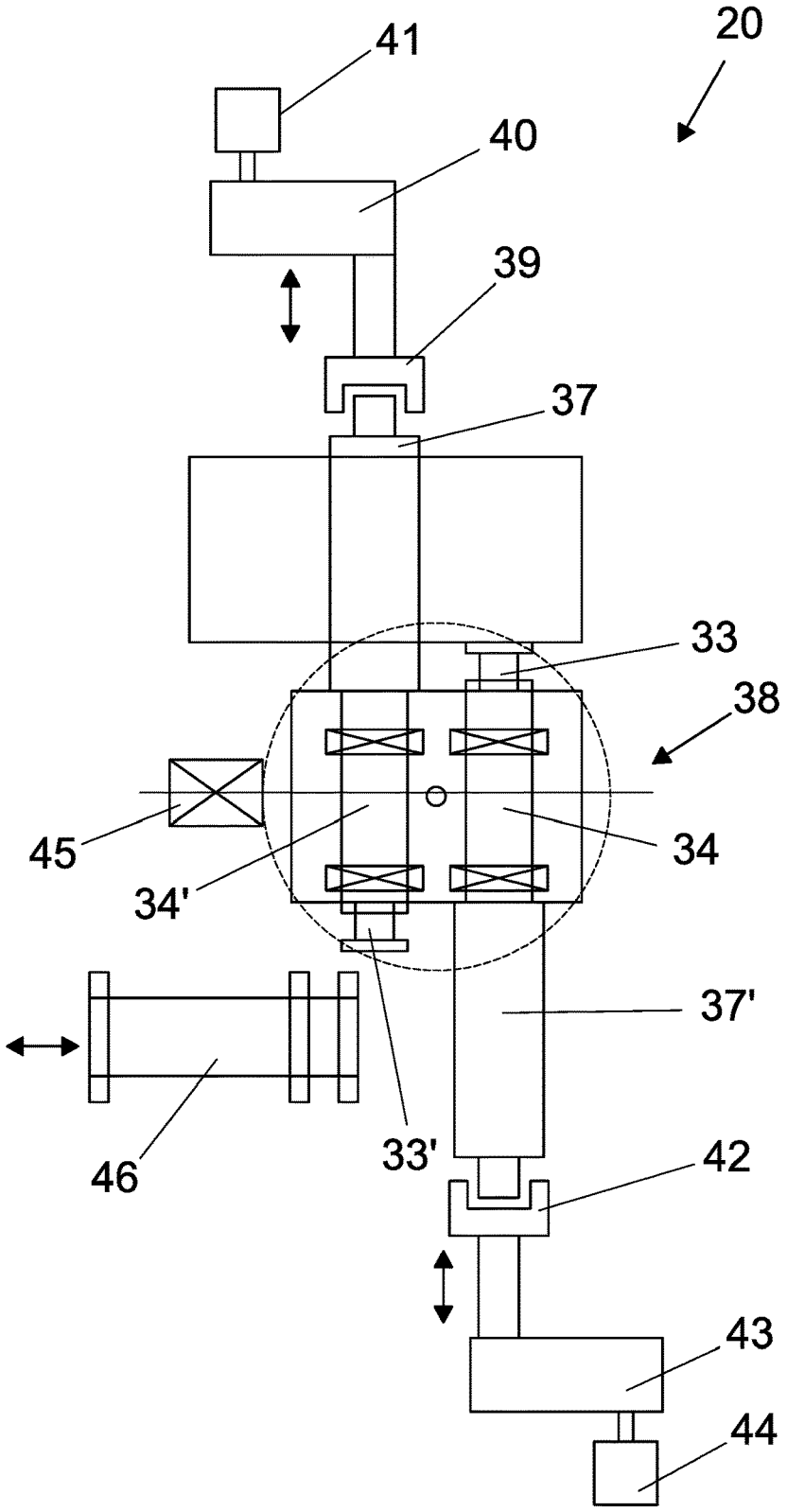
FIG. 3 is a diagrammatic view of a dual strip winding and unwinding system.

After the laminar cooling in the cooling device 12, the continuous strip enters into the accumulation means 20 and is wound, for example, on the high-capacity reel 37 of the rotatable platform 38 (FIG. 3).

Figure 4:
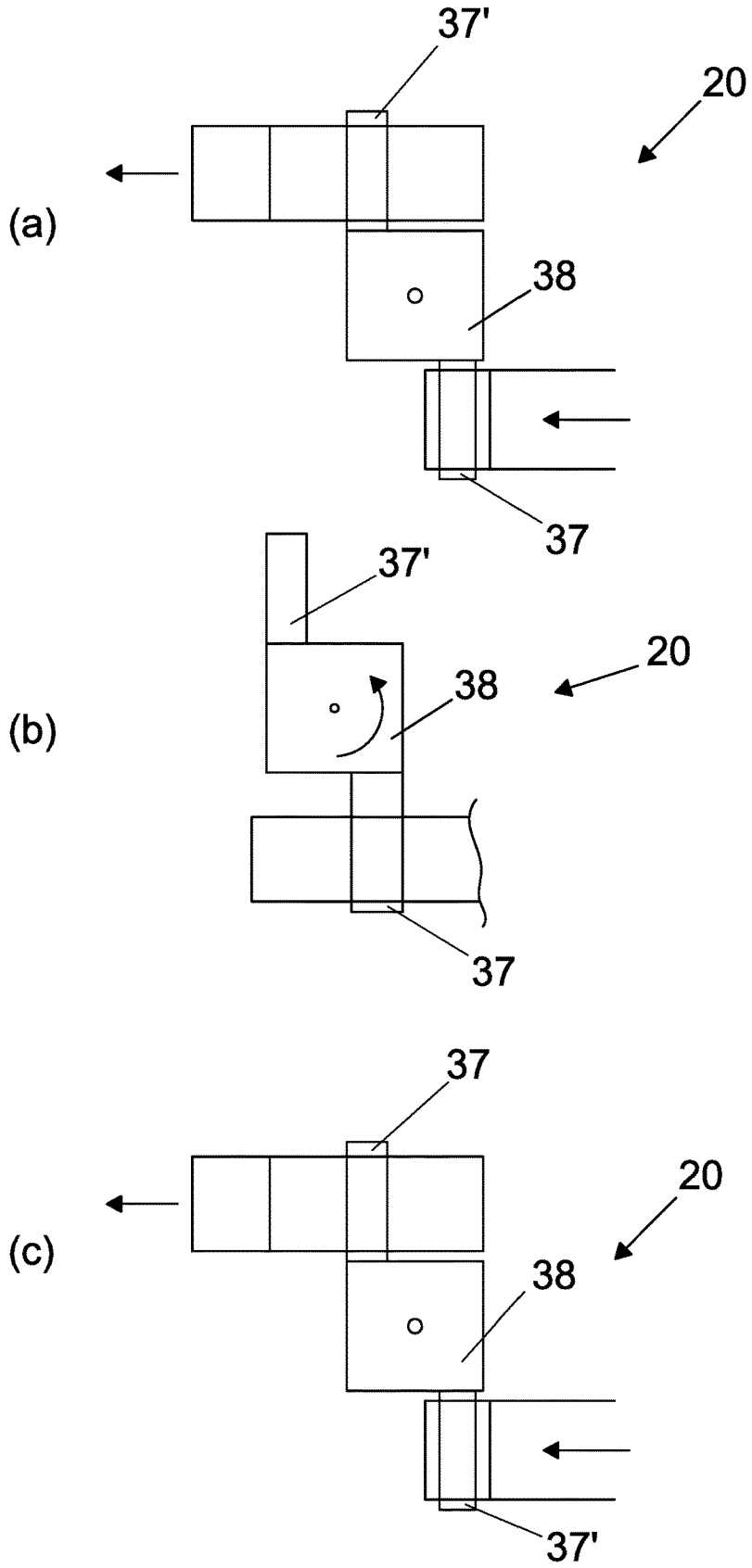
FIG. 4 is a working sequence of the aforesaid dual strip winding and unwinding system.

FIG. 4 diagrammatically shows the working sequence at full rate of the rotatable platform 38. In a first step (FIG. 4*a*), the reel 37 starts winding a mega coil of strip, while the reel 37' starts unwinding another mega coil, previously wound, toward the reels 48.

In a second step (FIG. 4*b*), while reel 37' completes the unwinding of another mega coil and remains empty, reel 37 completes the winding of the mega coil of strip, the winding is interrupted, the strip is cut upstream of the rotatable platform 38 by the cutting means 13, so that the tail of the cut strip is wound and completes the formation of the mega coil. So, the rotatable platform 38 starts turning to take said reel 37 to the unwinding position of the strip toward the reels 48.

If, upon completion of the winding of the mega coil on the reel 37, the reel 37' is not yet empty, the head of the strip obtained by cutting with the cutting means 13 is routed onto the conventional winding systems 14, having adjusted the plant to produce a strip of thickness such as to be able to be conveniently wound on such systems 14. Once having completed the unwinding of the mega coil from the reel 37', the rotatable platform 38 starts turning to take the reel 37 into the unwinding position.

In a third step (FIG. 4*c*), with the reel 37 in the unwinding position, the strip is unwound from the reel 37 toward the reels 48, while the reel 37' begins winding a new mega coil of strip.

During the unwinding of the strip from one of the two reels 37, 37', the strip is led in through the cutting and winding line 21. When a reel 48 winds a first coil having a specific weight not exceeding 20 kg/mm, preferably from 10 to 20 kg/mm, and having a maximum weight not exceeding 35 metric tons, the unwinding reel 37 or 37' stops, dedicated sensors send a command signal to the static cutting shears 47, which cuts the strip being wound on the reel 48 and the first coil is unloaded from the reel 48. The head of the strip obtained by the cutting of the shears 47 is led into a further reel 48 and the unwinding from the unwinding reel 37 or 37' resumes until a second coil is obtained on the further reel 48 having the aforesaid specific weight, weight or maximum diameter of the coil. The process continues with this working method until the complete unwinding of the mega coil, from which from 5 to 8 coils are obtained, onto the reels 48.

If it were desirable to make the plant work without using the third rolling mill 18, the strip rolled to conventional thickness from 1 to 25 mm can be wound on the winding systems 14.

In a second advantageous method of operation, rolling is provided in the rolling mill 18 in ferritic range, instead.

The process performed in this second method is the same as to the one performed in the first method, except for the fact that the strip is cooled by the rapid cooling device 16, instead of the heating of the strip by the rapid heating device 15.

This makes it possible to go from rolling in austenitic range, as occurs both in the roughing mill 6 and in the finishing mill 11, to rolling in ferritic range in the third rolling mill 18. Furthermore, in case of passage to rolling in ferritic range the use of the further rapid cooling device 19, downstream of the rolling mill 18, is not provided.

In particular, in a first variant, the rapid heating device 15 is retracted off-line, while the rapid cooling device 16 is inserted in-line so that the strip before entering in rolling stands 17 of the rolling mill 18 is already in ferritic range at the most suitable temperatures to achieve the desired cycle. Indeed, there are several types of ferritic rolling according to whether it is desired to obtain a recrystallized microstructure after winding for direct use (deformation and winding temperature must therefore be sufficiently high) or a raw microstructure which requires an annealing process downstream to recrystallize. The difference between the different cycles, by controlling the deformation and the winding temperature consists in a different texture of the ferritic grains after recrystallization, and hence a more or less forced improvement in ductility and moldability properties (in general terms, ductility properties are promoted by a low rolling temperature).

Figure 6:
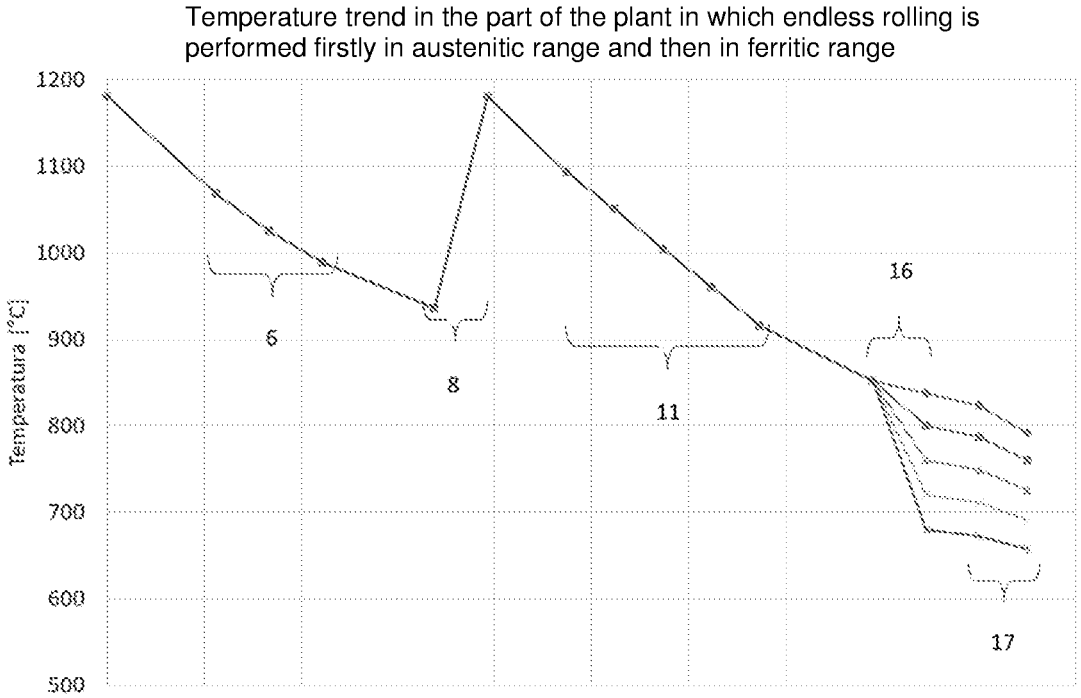
FIG. 6 is an example of the temperature trend in part of the plant in which the endless rolling is performed firstly in austenitic range and then in ferritic range.
Figure 8:
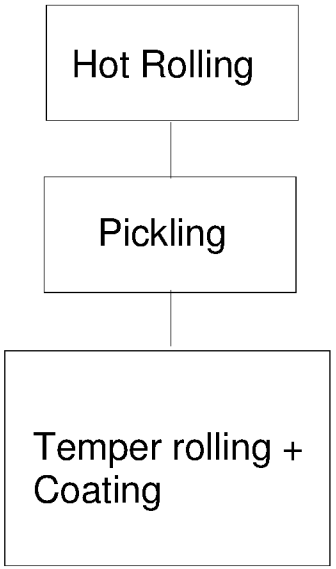
FIG. 8 is a block chart of a plant according to the invention.
Figure 7:
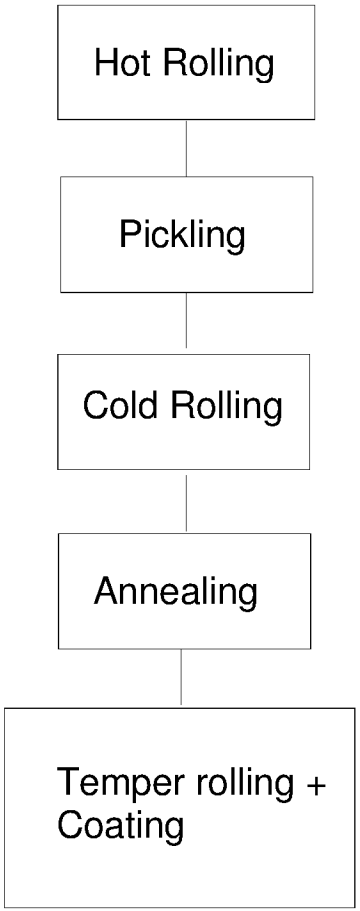
FIG. 7 is a block chart of a plant according to the prior art.

An example of the temperature trend is shown in FIG. 6, in which the numbers are referred to the components shown in FIG. 1.

Handling devices are preferably provided for alternatively inserting in-line or retracting off-line the rapid heating device 15 and the first rapid cooling device 16.

Advantageously, in all the embodiments of the plant of the invention, devices may be provided for automatically adjusting the gap between the working rolls of the at least two rolling stands 17 of the rolling mill 18.

Said adjusting devices comprise, for example, an adjustment controller cooperating with thickness and strip speed gages, the measurements of which are used by the controller to modify the parameters of the main actuators of the rolling stands 17, in particular to change speed and torque of the rotation motors of the working rolls and the position of the hydraulic capsules which control the gap between the working rolls.

These adjustment devices make it possible to produce stretches of strip of different thickness between them; preferably, but not necessarily, with initial stretches of strip with decreasing thickness from a first initial stretch to the successive one, up to a central stretch, and with final stretches of strip, successive to said central stretch, with increasing thickness with respect to the central stretch and increasing from a first final stretch to the last final stretch. A sequence of stretches of strip of different thickness may be for example:

first stretch of 1.0 mm of thickness, weighting 20 metric tons, second stretch of 0.8 mm of thickness, weighting 20 metric tons.

third stretch of 0.6 mm of thickness, weighting 20 metric tons, fourth stretch of 0.5 mm of thickness, weighting 100 metric tons, fifth stretch of 0.6 mm of thickness, weighting 10 metric tons, sixth stretch of 0.8 mm of thickness, weighting 10 metric tons, and then back to a last stretch of strip which is 1.0 mm thick.

Advantageously, the first stretch is rolled to a thickness greater than 0.8 mm, so that it is easier to cut with the cutting means 13, preferably flying shears, and to lead in on the fly the head of the strip obtained on the accumulation means 20, e.g. on the reel 37.

At this point, the thickness at the outlet of the rolling stands 17 may be gradually reduced by seamlessly winding a mega coil from 3 to 6 meters in diameter and weight from 80 to 250 metric tons composed of lengths of strip of different thicknesses on the accumulation means 20. The last stretch of strip is rolled again to the thickness exceeding 0.8 mm so as to cut on the fly the head of the strip with the flying shears 13 and lead said head of the strip on the fly on the conventional winding systems 14.

In the example above, a 180-metric ton mega coil of strip with stretches of different thickness is wound on the accumulation means. The tail is locked by pinch roller 50 and deflector 51 placed before the winding reel 37.

The mega coil is fully wound onto the reel 37, with the first stretch and the last stretch of the strip thicker than 0.8 mm and with intermediate stretches of strip with a thickness less than or equal to 0.8 mm, is displaced by rotation of the rotatable platform 38 into the unwinding position. Once this position is reached, there will be a mega coil ready to be unwound from the reel 37 and a winding reel 37' in winding position, ready to begin a new winding sequence.

At this point, the mega coil starts being unwound from the reel 37 and introduced into a line of cutting and winding line 21, in which the stretches of strip of different thickness are divided into coils of specific weight from 10 to 20 kg/mm, whereby obtaining coils up to 35 metric tons, preferably from 8 to 35 metric tons of weight.

In an embodiment of the plant of the invention, the stretches of strip at different thickness are identified and separated by the static shears 47 and the corresponding coils of strip are wound on an appropriate winding and unloading station comprising reels 48. A thickness gage is advantageously provided which detects the jump of thickness of the strip and an automatic command stops the portion of strip which includes the jump of thickness at the shears 47, so that a portion of strip of equal thickness is wound on a reel 48 to form a coil. The unwinding/winding speed of the accumulation means 20 and the cutting cycle and winding on reels 48 will be dimensioned in such a way that the cutting and winding line 21 has a hourly production rate which is either equal to or higher than the hourly production rate of the continuous casting machine which feeds the downstream rolling process.

A further variant of the combined continuous casting and metal strip hot-rolling plant, instead, provides a "coil to coil" operation, in which the continuous casted slab is cut into pieces of slab, by the shears 2 or 7, to a size such that, at the end of the rolling process, by means of reductions in thickness only in the rolling mills 6 and 11, a coil of strip of the desired size directly wound on the winding reels 14 is obtained for each piece of slab. In this variant, a rapid cooling device 9 is provided, which can be activated, when heating does not need to remain in austenitic range to enter into the finishing mill at temperature lower than the non-recrystallization temperature.

In this description, the rapid cooling devices 9, 16, 19 are, for example, devices for the production of blades or sprays of liquid on both the upper and lower surfaces of the strip, which may use pressurized liquid by means of nozzles or only by means of conveying holes.

The invention claimed is:

1. A combined continuous casting and endless rolling plant for a metal strip, comprising a continuous casting line for casting a slab;

a first rolling mill for roughing the slab and for obtaining a transfer bar;

a second rolling mill for finishing the transfer bar and for obtaining a strip;

accumulation means of the strip comprising at least one first reel dimensioned to wind and unwind a coil weighing from 80 to 250 metric tons and/or up to 6 meters in diameter, named mega coil;

characterized in that there are provided a third rolling mill, comprising at least two rolling stands, for further reducing a thickness of the strip;

a first cutting means, arranged between said third rolling mill and said accumulation means, configured to cut the strip after the mega coil has been wound on the at least one first reel;

at least one second reel for winding portions of strip, unwound from said accumulation means, up to a predetermined weight limit or coil diameter limit;

a second cutting means, arranged between said accumulation means and said at least one second reel, adapted to cut the strip whenever a portion of strip wound on the at least one second reel reaches said predetermined weight limit or coil diameter limit.

2. The plant according to claim 1, wherein a first rapid heating device and/or a first rapid cooling device are provided between the second rolling mill and the third rolling mill; said first rapid heating device being adapted to be activated if rolling is kept in austenitic range, and said first rapid cooling device being adapted to be activated if the rolling is changed from austenitic range to ferritic range.

3. The plant according to claim 1, wherein said accumulation means comprise two first reels integral with a rotatable platform, adapted to rotate about a vertical axis, whereby, alternatively, one reel of said two first reels is used as winding reel of the strip coming from the third rolling mill, and the other reel of said two first reels is used as unwinding reel of the strip to feed said strip towards said at least one second reel.

4. The plant according to claim 1, wherein a first laminar cooling device is provided between the third rolling mill and the first cutting means.

5. The plant according to claim 1, wherein automated adjustment devices of a gap between working rolls of said at least two rolling stands are provided to produce stretches of strip of mutually different thickness.

6. The plant according to claim 5, wherein said automated adjustment devices comprise at least one strip thickness gage, adapted to detect jumps of strip thickness, and an automatic control system, cooperating with said at least one strip thickness gage and configured to stop a portion of strip which includes a thickness jump at the second cutting means.

7. The plant according to claim 1, wherein there are provided at least two winding systems arranged between the first cutting means and the accumulation means.

8. A continuous casting and endless rolling process of metal strip, by means of a plant according to claim 1, comprising the following steps:

a) casting the slab by means of the continuous casting line;

b) roughing the slab to obtain the transfer bar by means of the first rolling mill;

c) finishing the transfer bar to obtain the strip by means of the second rolling mill;

d) further reducing the thickness of the strip by means of the at least two rolling stands of the third rolling mill;

e) winding the strip, by means of the at least one first reel of the accumulation means, to form the coil weighing from 80 to 250 metric tons and/or up to 6 meters in diameter, named mega coil;

f) cutting the strip by means of the first cutting means, after the mega coil has been wound on the at least one first reel;

g) unwinding the strip from the at least one first reel and winding a portion of strip on the at least one second reel up to a predetermined weight limit or coil diameter limit, whereby defining a first coil;

h) cutting the strip, by means of the second cutting means, after forming said first coil;

i) winding on said at least one second reel further portions of strip up to said predetermined weight limit or coil diameter limit, whereby defining further coils, cutting the rolled strip by means of the second cutting means after forming each of said further coils.

9. The process according to claim 8, wherein, between step c) and step d), either a rapid heating is provided by means of a first rapid heating device to keep rolling in austenitic range or a rapid cooling is provided by means of a first rapid cooling device to pass from a rolling in austenitic range to a rolling in ferritic range.

10. The process according to claim 9, wherein between step b) and step c), a rapid heating by means of a second rapid heating device is provided.

11. The process according to claim 9, wherein, after step d), a laminar cooling is provided by means of a laminar cooling device and, if the rolling is kept in the austenitic range, between step d) and said laminar cooling a rapid cooling can be provided by means of a second rapid cooling device.

12. The process according to claim 8, wherein there are provided two first reels integral with a rotatable platform adapted to rotate about a vertical axis, and, after a first mega coil is wound on a reel of said first two reels, the rotatable platform rotates so that the other reel of said two first reels is used as winding reel of the strip to make a second mega coil, while the reel of said first two reels is used as unwinding reel of the first mega coil to feed the at least one second reel, and so on.

13. The process according to claim 12, wherein unwinding/winding speed of the two first reels and cutting and winding speed of the strip on the at least one second reel are dimensioned so that accumulation means, second cutting means and the at least one second reel have a first hourly rate which is either equal to or greater than a second hourly rate of the continuous casting machine which feeds a downstream rolling in the first rolling mill, second rolling mill and third rolling mill.

14. The process according to claim 8, wherein said predetermined weight limit is variable from 8 to 35 metric tons, and said predetermined coil diameter limit is a maximum diameter of the coil equal to 2.1 meters.

15. The process according to claim 8, wherein making stretches of strip having mutually different thickness is provided in step d).

16. The process according to claim 15, wherein in step d), the process starts by rolling a strip with thickness greater than or equal to 1 mm, which is initially wound on winding systems, arranged between the first cutting means and the accumulation means;

subsequently, the strip is cut by means of the first cutting means and a tail of cut strip is wound on a winding system, while a head of strip obtained by cutting is routed towards the least one first reel;

after the at least one first reel has tensioned the strip, gradually the third rolling mill starts rolling the strip, producing stretches of strip of different thicknesses which are seamlessly wound on the at least one first reel.

17. The plant according to claim 2, wherein a second rapid heating device is provided between the first rolling mill and the second rolling mill.

18. The plant according to claim 2, wherein a second rapid cooling device is provided immediately downstream of the third rolling mill, arranged between said third rolling mill and a laminar cooling device.

19. The plant according to claim 3, wherein said accumulation means comprises at least one metallic belt wrapper to better receive a head of a strip to be wound on one of said two first reels.

20. The plant according to claim 5, wherein said automated adjustment devices are provided to produce a plurality of first stretches of strip with decreasing thickness from a first stretch to a successive first stretch, and a plurality of second stretches of strip, successive to said first stretches, with increasing thickness from a second stretch to a successive second stretch.

* * * * *